US008172166B2

(12) United States Patent
Inoue et al.

(10) Patent No.: US 8,172,166 B2
(45) Date of Patent: May 8, 2012

(54) ROLL MILL WITH AUTOMATIC CONTROL OF ROLL-TO-ROLL DISTANCE AND INTER-ROLL PRESSURE

(75) Inventors: Yoshitaka Inoue, Tokyo (JP); Choji Hatsugai, Utsunomiya (JP)

(73) Assignee: Inoue Mfg., Inc. (JP)

( * ) Notice: Subject to any disclaimer, the term of this patent is extended or adjusted under 35 U.S.C. 154(b) by 200 days.

(21) Appl. No.: 12/590,155

(22) Filed: Nov. 3, 2009

(65) Prior Publication Data

US 2011/0101139 A1 May 5, 2011

(51) Int. Cl.
*B02C 25/00* (2006.01)

(52) U.S. Cl. ..... 241/37; 241/230; 241/237

(58) Field of Classification Search ..... 241/37, 241/230, 237

See application file for complete search history.

(56) References Cited

U.S. PATENT DOCUMENTS

| | | | | |
|---|---|---|---|---|
| 2,680,978 | A * | 6/1954 | Sims et al. | 72/10.4 |
| 2,736,217 | A * | 2/1956 | Blain | 72/13.4 |
| 3,496,743 | A * | 2/1970 | Stone | 72/10.4 |
| 5,372,315 | A | 12/1994 | Kranz et al. | 241/30 |

FOREIGN PATENT DOCUMENTS

| | | |
|---|---|---|
| EP | 0953290 | 11/1999 |
| JP | 183438 | 6/1989 |
| WO | 2007121596 | 11/2007 |

* cited by examiner

*Primary Examiner* — Faye Francis
(74) *Attorney, Agent, or Firm* — Adams & Wilks

(57) ABSTRACT

A roll mill for a milling-dispersing treatment has a fixed roll fixed to a frame, and a transfer roll displaceable into and out of contact with the fixed roll in a direction perpendicular to the fixed roll by a servomotor and a ball screw. A laser sensor disposed between the fixed roll and the transfer roll measures the distance between the rolls, and a load sensor measures a pressing force between the rolls. An electronic automatic control device maintains a constant distance and a constant pressing force between the fixed roll and the transfer roll by feedback of detection signals sent from the respective sensors, wherein the servomotor is driven by the electronic automatic control device to adjust the position of the transfer roll.

19 Claims, 6 Drawing Sheets

ROLL MILL WITH AUTOMATIC CONTROL OF ROLL-TO-ROLL DISTANCE AND INTER-ROLL PRESSURE

BACKGROUND OF THE INVENTION

1. Technical Field

The present invention relates generally to a roll mill used for wet-dispersion, and more particularly to a roll mill for use in milling-dispersing a substance, such as fine powder, or nano particles, in a material to be treated in production steps of various products such as ink, paint, ceramics, medicines, foods and electronic materials.

2. Background Technology

As an apparatus for a milling-dispersing treatment of a substance, such as fine powder or nano particles, in a material to be treated, plural rolls having different numbers of revolutions, for example, a triple roll mill having a front roll, a center roll and a rear roll arranged in parallel in a lateral direction, have been widely used. In such a roll mill, as described in, e.g., JP-UM-A-1-83438, a load exerted between the rolls is detected by a load sensor (load cell), and the front roll and rear roll are moved by a manual handle to adjust the distance between the rolls. If it is attempted to conduct an automatic control by, e.g., a servomotor instead of such a manual handle, the below-mentioned various problems are caused and therefore it is difficult to correctly conduct automatic control with only the load control by the load sensor.

As shown in explanatory FIG. 1, a roll mill for a milling-dispersing treatment of a material to be treated generally comprises a rear roll and a front roll movably mounted on a frame, and each roll has a roll shaft on each end portion thereof. Each roll shaft is rotatably mounted by a bearing (not shown), and a pressing force is applied via the roll shafts. Bearings for the roll shafts of a center roll, which is positioned between the rear roll and the front roll, are fixed on the frame. For ease of explanation, only the fixed center roll (lower roll) and movable rear roll (upper roll) are illustrated in FIG. 1, and the description of the rear roll applies as well to the front roll. Therefore, between the rolls, a pressing force "b" is exerted on a contact line of the roll on the pressing side and a reaction force "a" is generated on a contact line of the roll on the fixed side. Crowns R1, R2 are formed on the surfaces of the rolls so that the pressing force (contact reaction force) has a constant distribution (flat single line) on the contact line, not like a curve c or d as shown in FIG. 2. During operation of the roll mill, the pressing side roll and the fixed side roll are rotated at different speeds (i.e., the numbers of revolutions of the rolls are different from each other) so that a frictional force is generated between the rolls, and the frictional force plays a significant role for dispersion effects.

The pressing force (or reaction force) and the crowns on the roll surfaces are in a delicate relation with a certain mutual relation, and this mutual relation must be theoretically determined based on an accurate relation between cause and result. It has been found that the frictional force applied between both rolls influences the pressing force (or reaction force) and the influence cannot be disregarded as fluctuations of the pressing force. Namely, the relation is represented by: (extrapolated pressing force P1, P2)=(pressing force on a contact line)+(fluctuations caused by frictional force). This extrapolated pressing force is not itself the pressing force applied on the contact line.

Taking such a phenomenon into account, basically, a finite-element analysis model of a combination of two rolls being in contact with each other is prepared; a nonlinear analysis wherein a contact portion is progressively extended while the load is incrementally added on the contact line, is conducted; and based on the analysis, relations of the pressing force P1 from the rear roll, the pressing force P2 from the front roll, the crown R1 of the rear roll, the crown R2 of the center roll, the crown R3 of the front roll, a distance δ1 between the rear roll and center roll, and a distance δ2 between the center roll and front roll can be specifically obtained.

Further, regarding the frictional force between the rolls, it has been known that if a frictional force exists as mentioned above, it creates fluctuations and draws the required pressing force toward the incorrect side. Accordingly, the pressing force of each roll and the distance between the rolls is necessary to maintain the relations of P1, P2, δ1 and δ2 when no frictional force is applied, and it is apparent that the remaining parameters after removing P1, P2, i.e., δ1, δ2, should be used as indexes. As a result, the operation of the roll mill should be controlled by control of the displacement of the rolls in such a manner that the distance between the rolls δ1, δ2 determined at the initial stage of processing is maintained throughout operation of the roll mill.

More specifically, the roll mill is limited by a certain roll size and also the pressing force on dispersion processing required by the users. Using these parameters, at first, a static analysis of the roll is once carried out. From this result, it is possible to determine the configuration of the crown curve formed on the roll and the peak value of the curve (which usually exists at the center). Then, by incorporating the analysis results, conversion to a roll analysis model including the information of crown is carried out. Using this model, a contact analysis model wherein only the crown peak portions at the center are in contact with each other from the initial stage, is made. One of the rolls is a fixed roll, and its both ends are supported, and a constant load is applied from both ends of another roll, and in this manner, a finite-element nonlinear contact analysis is carried out in accordance with a load incremental analysis method. Accordingly, the load is finely classified into respective steps and finally reaches P1 or P2. The result shows the configuration represented by "constant reaction force" in the graph of FIG. 2. From this result, a distribution having a constant pressing force (or reaction force) on the contact line is obtained, and concomitantly R1, R2, R3, P1, P2, δ1, δ2 are obtained as interrelated numerical values. Among them, R1, R2, R3 are used as the crown amounts at the time of designating the rolls, and the rest, i.e., P1, P2, δ1, δ2 are numerical values used for automatic control.

As mentioned above, basically, the automatic control of a roll mill is preferably carried out by the control of displacement of the rolls by detecting the position of the rolls with a sensor. However, since the following problems are caused when using only control of displacement, it is necessary to conduct a partial correction by monitoring the load in addition to the control of displacement. At first, the following problem is caused by an unbalance of loads between the right and left ends of the roll. As shown in FIG. 3, usually, a contact line pressure between the rolls is that of a substantially flat distributed load at the portion that balances with the crown configuration formed on the roll. However, in actuality, in FIG. 3, when A, B are fulcrums, C is a center point, AC=L2 and CB=L1, and the distributed load is a little larger at the center point C where AB/2=L1=L2.

Further, since it is better for simplification of analysis to assume that the distributed load is replaced with a concentrated load at the center point C, explanation will be made hereinafter on an assumption that a concentrated load P2 (P1) is applied at this point. Then, it is clearly understood that moments P2×L1 and P2×L2 are applied at both sides A,B of the point C. However, the distribution of contact line pressure may sometimes be shifted as shown in the lowest part of FIG. 3 due to a disturbance occurring during operation of the roll mill. At this time, the position of P2 may be shifted from the center point C, for example, L1>L2 (of course, L2>L1 may happen). If load control works at this time, the total P2 does not change, and as a result, the above moments become P2×L1>P2×L2 and a moment difference between the left and right sides is caused. In this instance, due to the moment difference, P2 is pulled toward the L1 side (B side), i.e., a larger moment side. If the relation is contrary, P2 is pulled toward the L2 side (A side). Accordingly, a force always works so that P2 remains at the center point C, and P2 acts as a so-called self-alignment force.

However, if the control is made by a feedback control only with the control of displacement, the above-mentioned self-alignment force does not work in this mechanism. Specifically, although an unbalance of load between the left and right ends of the roll can be corrected by the control of displacement, some phenomenon has been often seen in actual operation with the control of displacement only, wherein when a minute unbalance is caused between both ends of the roll, although no substantial error in numerical values of displacement is recognized, a minute unbalance in terms of the load is often detected.

The relation between load and displacement under actual operation and the relation between load and displacement under static load will be considered below. When the pressing force P2 (P1) is applied to the roll as mentioned above, the roll contacting parts momentarily deform and have collapsed portions as shown in the cross-sectional view of FIG. 4. Namely, when the radius of the roll is R and the distance between the rotational centers of the roll shafts is D in FIG. 4, 2R>D. When the collapse allowance at this time is 2R−D=2d, "d" is the collapse allowance of one roll. The control is made by employing D as the distance between rolls δ1 (δ2).

At the time when raw materials are fed in the machine, actual operation for control of displacement is carried out by employing "D+e" as the actual numerical value for control of displacement taking the clearance "e" where the raw materials are nipped into account, not by employing the distance D between roll shafts. Accordingly, it is required to see whether or not the load agrees with a statistically determined P2 (P1) under actual operation with the control of displacement, and it is also required to detect a monitor value of a load cell and to operate with D+e that agrees with P2 (P1). For this purpose, in such instance, the control is carried out by employing D+e as the distance between rolls δ1 (δ2).

Generally, "e" is called a nip in the technical field of roll mills, and more specifically, the nip of the material-feeding side (first clearance) is called a feed nip, and the nip of the material-dispersing side (secondary clearance) is called an apron nip. Both the feed nip and the apron nip are referred to as simply "nip" hereinafter.

Further, since materials to be treated are dragged into the nip between rolls during a milling and dispersing operation, a film thickness of the materials through the nip at the initial stage is "e" which is the same as the clearance "e". However, it is known that the film thickness e reduces as the milling and dispersing operation proceeds. When the change of the film thickness e with time is empirically expressed as a function with respect to time e(t), the distance between rolls δ1 (δ2) can be controlled as D+e(t).

Furthermore, it is a well-known fact that when the materials to be treated are fed in a triple roll mill, depending on the properties of the materials, the viscosity of the materials tends to decrease as the dispersion proceeds. Assuming that this machine is used by cycling the materials in a multiple number of passes, if only control of displacement is used while the viscosity decreases, the load applied to the materials may possibly decrease as the number of passes increases, resulting in ineffective operation. At present, triple roll mills are typically used in multiple-number-of-pass operations. In such cases, it is required to utilize a load cell (load sensor) monitor, and if the mechanism of the machine is designed so that when the reduction of the viscosity of materials falls below a prescribed value, correction can be made with a program without external processing, whereby users can conduct the desired dispersion by a one-step dispersion treatment. As explained above, although the operation control is made by the control of displacement, a mechanism is provided wherein the load is monitored by a load cell (load sensor) and fluctuations are adjusted by a program.

Furthermore, there is a problem when an abnormal load occurs. In operation of a triple roll mill, if a substance larger than normal (i.e., larger than that for which the parameters of the rolls have been designed) is erroneously inserted between the rolls, a control mechanism using only control of displacement will cause a vast load to be applied so as to keep the roll displacement within preselected limits, which may disrupt the operation of the machine or damage the machine. In order to deal with such a problem, a load cell (load sensor) for measuring a pressing force is inserted into a control system, by which a program can be constructed wherein when a trigger-type abrupt unavoidable displacement happens, application of a vast load can be avoided by a rapid feedback so as to protect the machine.

The load cell is effective for incorporating so-called safety measures for avoiding abnormal load. In addition to the above case where a substance larger than normal is erroneously inserted between the rolls, a substantial difference in displacement may be seen by a uniform distinctive variation of viscosity or uneven distribution of materials to be treated on the rolls. It has also been confirmed that when such things continuously happen, the control of displacement is a little inferior to the control of load in view of the temporal efficiencies in control for constricting this difference.

Accordingly, in order to avoid such redundancy and obtain rapid control, it is more preferred that the program be constructed so that when a large, but not a level of emergency shutdown, disturbance is caused, the control is temporarily changed from the control of displacement to the control of load, and immediately after constraint of the disturbance, the control is returned from the control of load to the control of displacement.

SUMMARY OF THE INVENTION

It is an object of the present invention to solve the above-mentioned problems by the control of displacement or the control of load using a roll mill in which the distance between rolls can be controlled by full-automatic control by which quality of distribution can be improved.

Another object of the present invention is to provide a roll mill that automatically controls the distance between rolls and the inter-roll pressure.

A further object of the present invention is to provide a roll mill that maintains a constant distance and a constant pressing force between a fixed roll and a transfer roll.

In accordance with one embodiment of the present invention, a roll mill for a milling-dispersing treatment comprises a fixed roll fixed to a frame; a transfer roll disposed in such a manner that it may be displaced into and out of contact with the fixed roll, the transfer roll being slightly movable in a direction perpendicular to the fixed roll by a servomotor and a ball screw; a laser sensor disposed between the fixed roll and the transfer roll for measuring the distance between the rolls; a load sensor for measuring a pressing force between the rolls; and an electronic automatic control device for keeping a constant distance and a constant pressing force between the fixed roll and the transfer roll by feedback of detection signals sent from the respective sensors, wherein the servomotor is driven by the electronic automatic control device to adjust the position of the transfer roll.

The roll mill of the present invention preferably comprises a triple roll mill having three rolls arranged in parallel in a lateral direction, wherein the fixed roll is a center roll fixed at the center of a frame, and the transfer roll comprises a front roll and a rear roll disposed before and behind the center roll, the front and rear rolls being individually automatically controlled.

The automatic control is basically configured to control roll displacement by monitoring the load with a load sensor and controlling the distance between the rolls with a laser sensor. A program is composed in such a manner that when a large disturbance occurs, the control is temporarily changed from a control of displacement to a control of load, and immediately after constraint of the disturbance, the control is returned from the control of load to the control of displacement. Furthermore, the present invention provides automatic control with a program in which the distance between the rolls is a numerical value obtained using a time-based derivative e(t) which shows a fluctuation of the film thickness e of the materials through the nip with time to the distance D between roll shafts taking into account the collapse (resilient deformation) of contacting rolls under operation.

In the present invention having the above-explained structure, automatic control is carried out by using the control of displacement and the control of load in combination, and a predetermined distance between the rolls can be maintained by a feedback control, by which it is possible to obtain a constant pressing force (reaction force) distribution on a contact line using rolls having crowns. In accordance with the present invention, a roll mill such as a triple roll mill can be operated continuously under a constant contact force, taking into consideration roll self-alignment, collapse allowance of rolls, viscosity fluctuation of materials to be treated, occurrence of abnormal load, etc. without losing the distribution effect by the frictional force generated by the different number of revolution of rolls. By using such a roll mill as a dispersing machine, it becomes possible to satisfy the demands for a high dispersion quality (precision). In other words, the particle size distribution after dispersion is narrower than in the case of conventional roll mills, and by employing the automatic control, it becomes possible to transfer the operation that has been relied on human control techniques from human skill to machine.

DETAILED DESCRIPTION OF INVENTION

Figure 1:
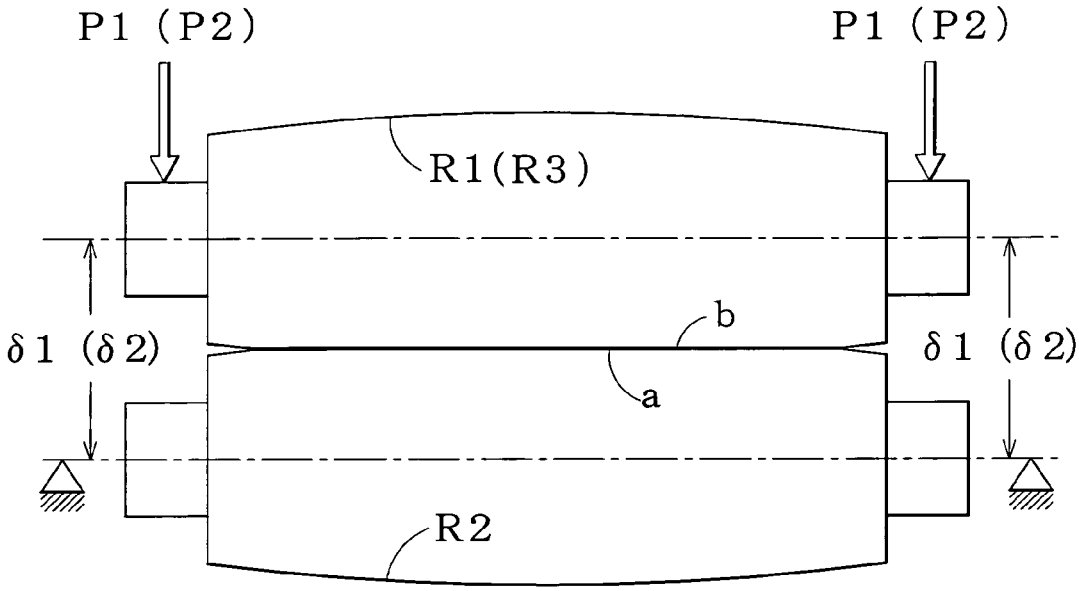
FIG. 1 is a schematic view showing a crown curve, a roll contact line, etc. when a fixed roll and a pressing roll (transfer roll) are in contact with each other with a constant pressing force.
Figure 2:
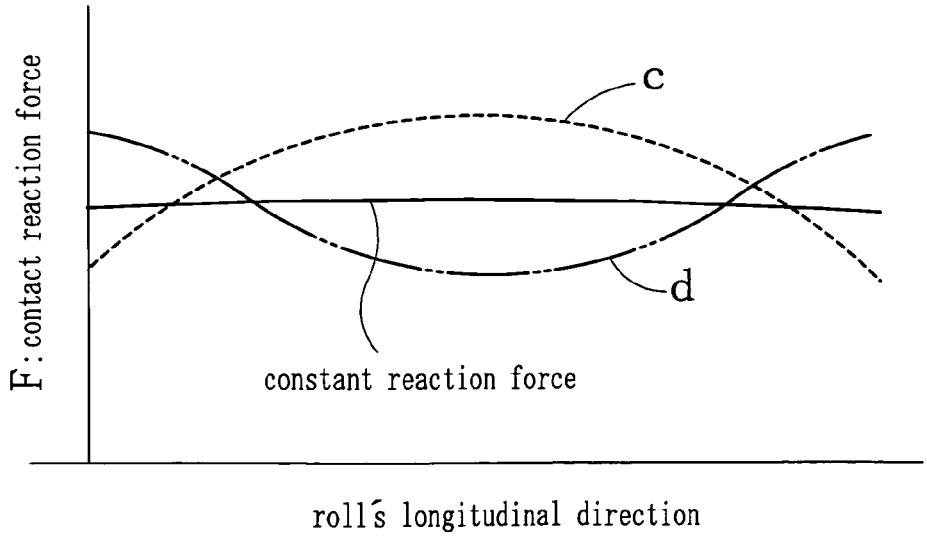
FIG. 2 is an explanatory graph showing a distributed pressing force (reaction force) on the contact line under the condition where the rolls are in contact with each other.
Figure 3:
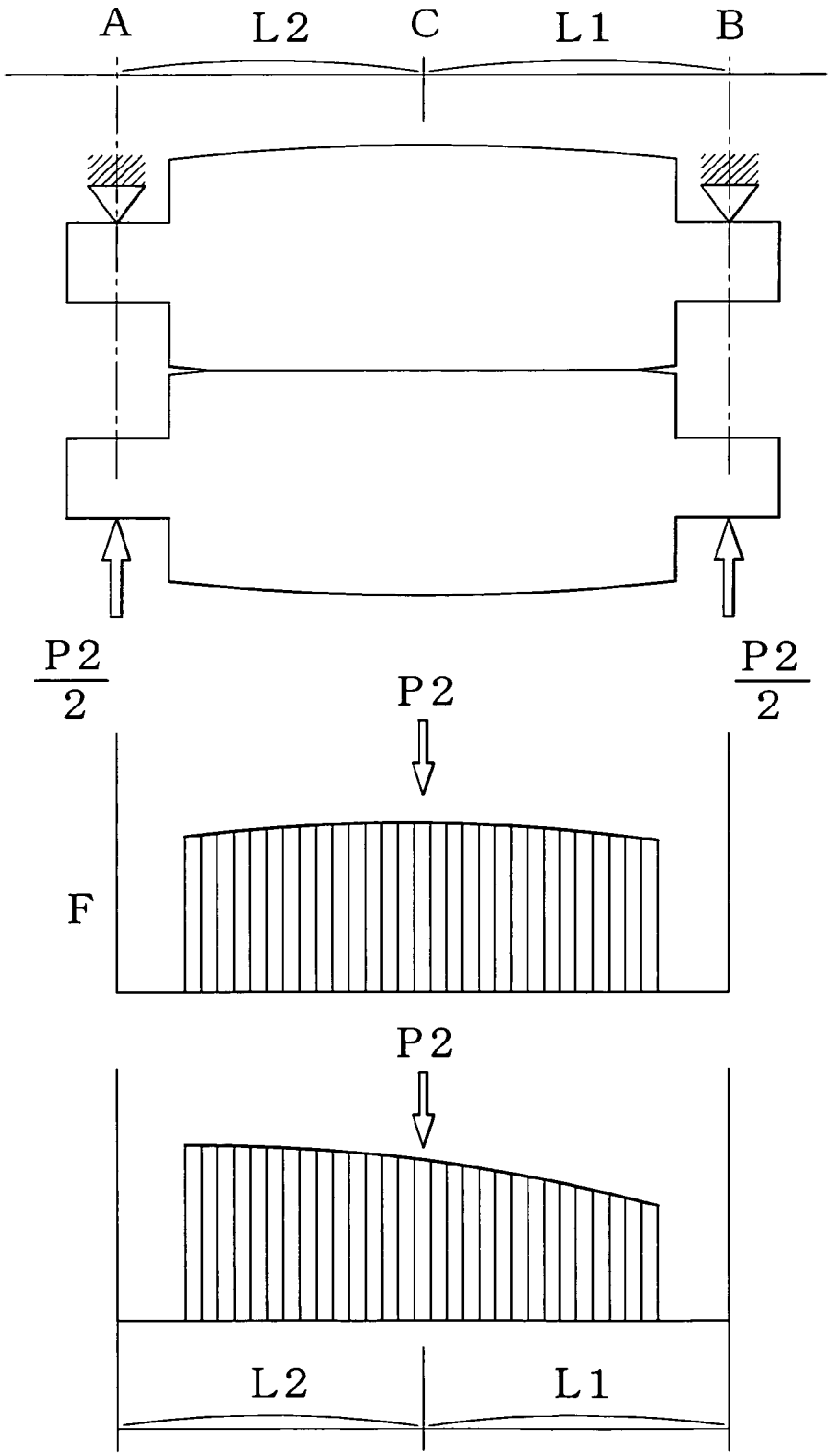
FIG. 3 is an explanatory view illustrating the relation between a pressing force distribution on the contact line and a self-alignment force.
Figure 4:
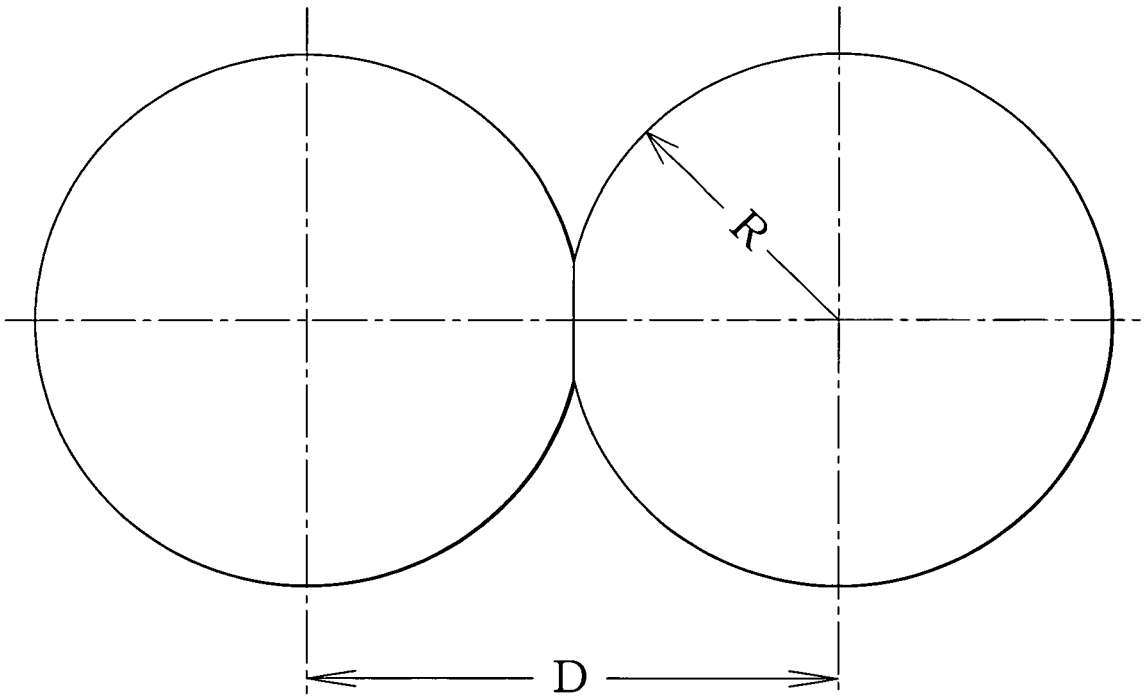
FIG. 4 is an explanatory view showing the distance between rolls accompanied with a collapse allowance of rolls when the pressing force is applied.
Figure 5:
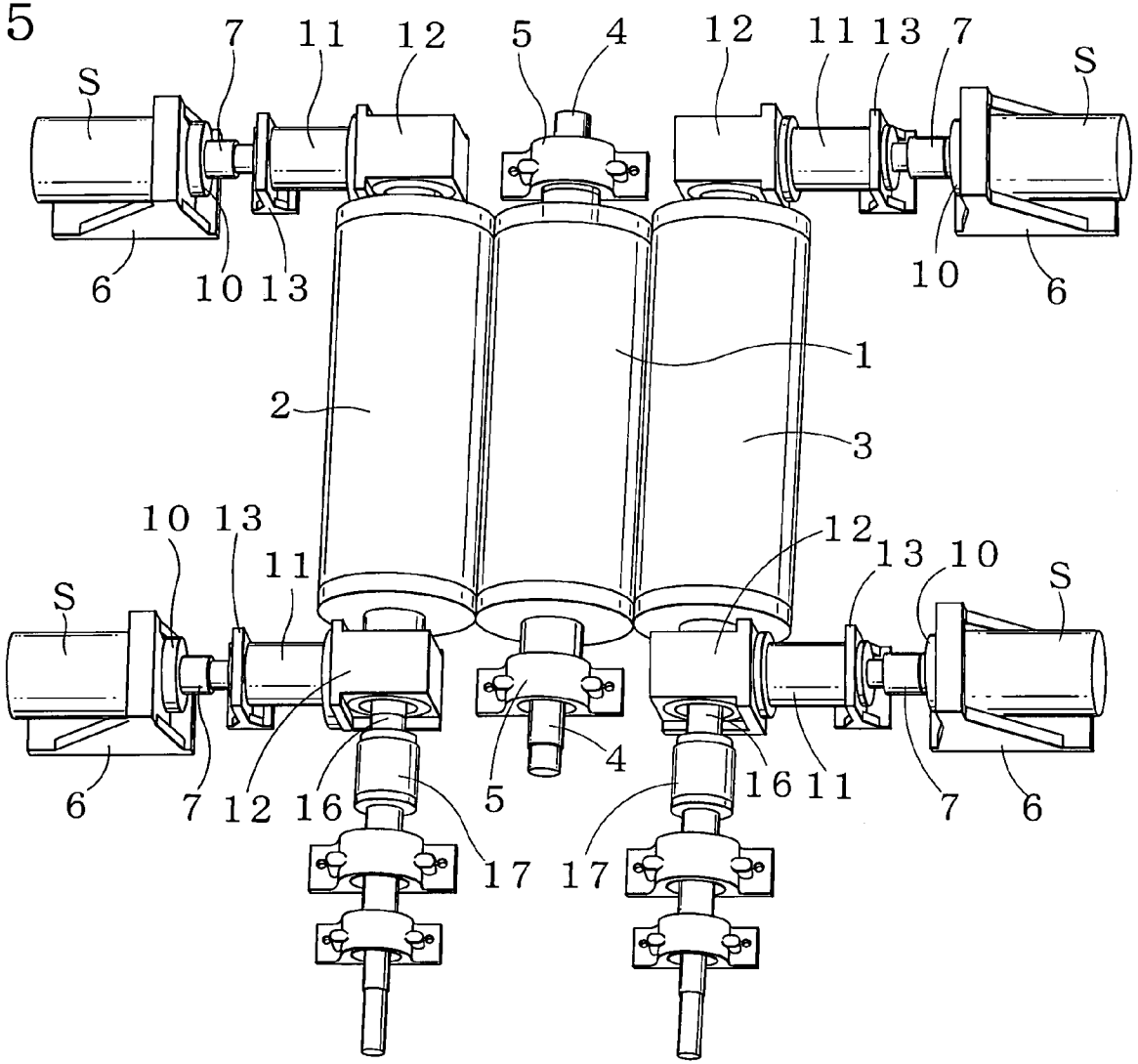
FIG. 5 is a top plan view of a triple roll mill showing an example of the present invention.
Figure 6:
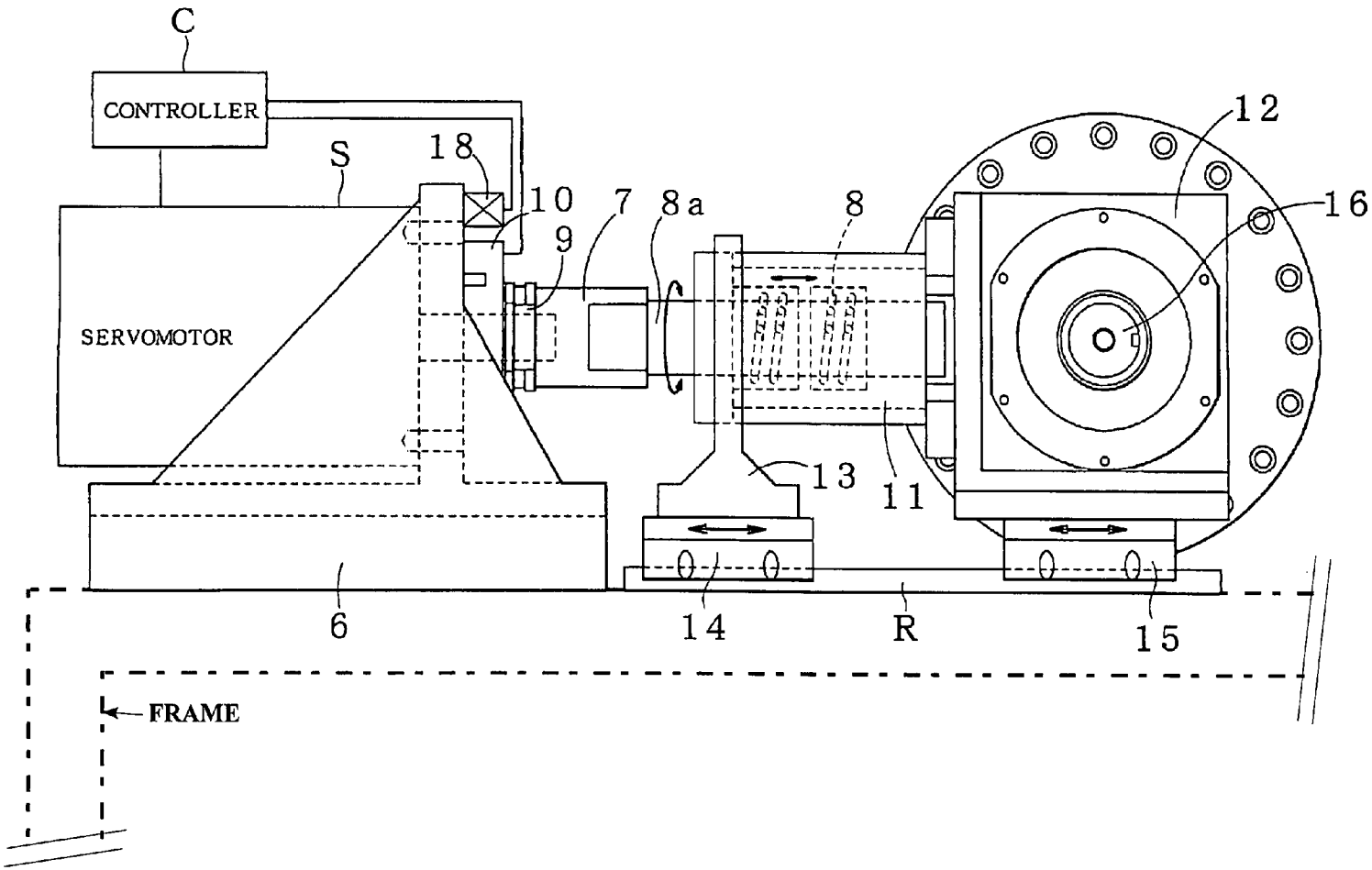
FIG. 6 is a front view showing one example where a transfer roll is installed on a frame.

The present invention is applicable to various types of roll mills to be used for a milling-dispersing treatment of a substance, such as fine powder or nano particles, in a material to be treated in production steps of various products such as ink, paint, ceramics, medicines, foods and electronic materials. FIGS. 5 and 6 illustrate one example of a roll mill according to the present invention, a triple roll mill comprising a center roll 1 fixed at the center and a front roll 2 and a rear roll 3 disposed in parallel before and behind the center roll 1 in the lateral direction in such a manner that the front and rear rolls may be moved into and out of contact with the fixed roll. In FIG. 5, a bearing 5 supports roll shafts 4 of the center roll 1 and is fixed to a frame (not shown), and the front roll 2 and rear roll 3 are positioned at both sides of the center roll 1.

The front roll 2 and the rear roll 3 are installed on the frame with substantially the same installation structures. FIG. 6 shows an example of an installed portion at one end of one of the front and rear rolls, which is representative of the installed portions at the other roll ends. At the left-hand side in FIG. 6, a servomotor bracket 6 is fixed to the frame, and a servomotor S used exclusively for displacement driving is mounted on the servomotor bracket 6, and the torque of the servomotor is transmitted to a ball screw coupling 7. In concurrence with the transmission of torque, the ball screw coupling 7 receives a reaction force transmitted via a ball screw 8 and transmits it to the servomotor bracket 6. For this purpose, a bearing 9 is inserted between the servomotor bracket 6 and the ball screw coupling 7, and a load cell (load sensor) 10 for measurement of the reaction force is installed between the servomotor bracket 6 and the bearing 9.

The ball screw 8 translates rotational motion to linear motion with little friction. In this example, the ball screw 8 comprises a threaded shaft 8*a* firmly connected to the ball screw coupling 7 to rotate in unison therewith by means of, for example, a key engagement. The threaded shaft 8*a* provides a spiral raceway for ball bearings retained in a ball assembly which acts as a nut while the threaded shaft acts as a screw. The torque transmitted to the screw coupling 7 by the servomotor S is transmitted to the threaded shaft 8*a* to rotate the threaded shaft to effect axial displacement of the ball assembly along the threaded shaft. Thus the torque is converted to linear motion within the ball screw 8, and the linear motion is transmitted to a ball bearing holder 12 via a roll push bar 11.

In this example, the ball screw 8 and the roll push bar 11 are installed on a holding plate 13 with the ball assembly of the ball screw fixed to the holding plate, and the holding plate 13 is mounted on and supported by a linear motion guide 14. Similarly, the roll bearing holder 12 is mounted on and supported by a similar linear motion guide 15. The linear motion guides 14,15 roll or slide along a pair of parallel rails R (only one of which is visible in FIG. 6) that extend in a direction perpendicular to the axis of rotation of the roll. When the ball screw 8 is rotated in, for example, a forward direction by the servomotor S, the roll push bar 11 is displaced forwardly (rightward in FIG. 6) to accordingly displace the ball bearing holder 12 in a direction toward the center roll (not shown in FIG. 6), and the linear motion guides 14,15 move along the rails R to facilitate and control the direction of displacement.

Figure 7:
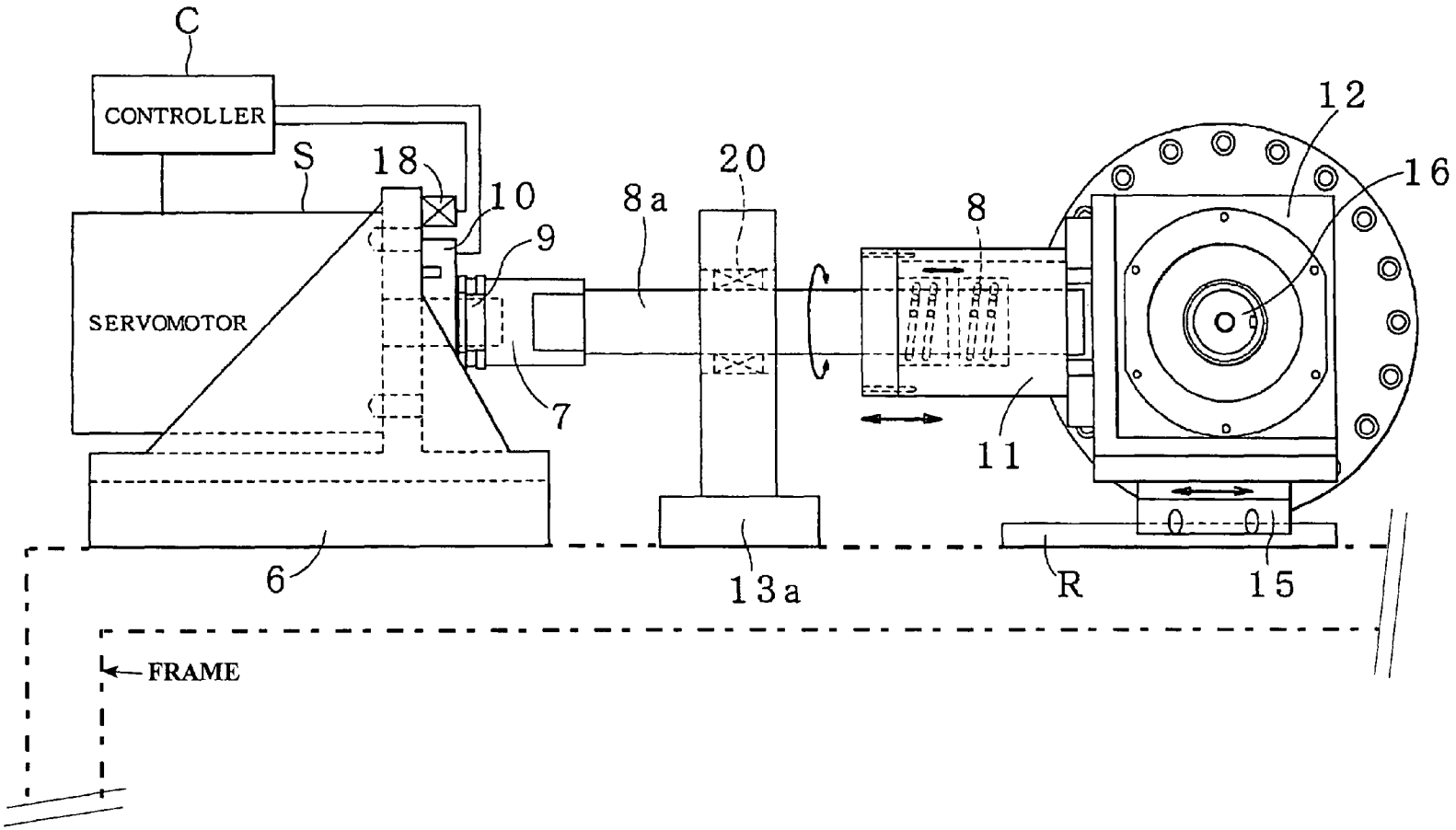
FIG. 7 is a front view showing another example where a transfer roll is installed on a frame.

In the example shown in FIG. 6, as the construction to support the ball screw so as to be movable axially, the ball screw 8 is fixed to the holding plate 13, which is movably installed to the frame through the linear motion guide 14. FIG. 7 shows an example wherein the holding plate is fixed to a frame, i.e., a holding plate 13*a* is fixed to the frame and the threaded shaft 8*a* is rotatably supported by the holding plate 13*a* through a bearing 20 such as a cylindrical rolling radial bearing. In this construction, the ball screw 8 is movable axially while supported by the holding plate 13*a*. In other respects, the example shown in FIG. 7 is the same as the example shown in FIG. 6.

As shown in FIG. 5, the front and rear rolls 2,3 each have a roll shaft 16 extending outwardly from opposite ends thereof, and the roll shafts are inserted into and rotatably supported by the roll bearing holders 12. To each roll shaft 16, a driving motor (not shown) is connected through a Schmidt coupling 17. As is known, a Schmidt coupling couples two rotatable shafts in such a manner that rotary motion is transmitted unchanged from one shaft to the other notwithstanding the fact that the shafts may simultaneously undergo translational (offset) movement relative to one another. The Schmidt coupling 17 has a mechanism that permits parallel translation (offset) of the motor driven shaft and the roll shaft during rotation in power transmission and transmits the rotation driving force from the driving motor to the roll shaft 16 at equal rotating velocities while allowing the roll shaft 16 to move in a perpendicular direction, i.e., a direction perpendicular to the axis of the roll shaft. In this manner, displacement of the front and rear rolls 2,3 relative to the center roll 3 can be effected while maintaining the axes of rotation of the three rolls parallel to each other.

In order to correctly measure the distance between the servomotor bracket 6 and the roll, a distance sensor, such as a laser displacement meter (laser sensor) 18, is fixed to the servomotor bracket 6, and the distance is measured by directly irradiating a roll flange portion at the end of the roll with a laser beam and receiving back the reflected laser beam.

The servomotor bracket 6 is fixed to the frame, and the bearing 5 for the roll shaft 4 of the center roll 1 is also fixed to the frame. Therefore, by measuring the distance between the servomotor bracket 6 and the roll (roll flange portion), the distance between the roll shaft 4 of the center roll 1 and the roll shaft 16 of the rear roll 3 (or the front roll 2) can be measured. The distance between the servomotor bracket 6 and the roll (roll flange portion) is determined by the initial pressing force (static) under a static condition of the roll, and thereafter a feedback control is carried out during operation of the roll so that the distance will be maintained constant. For this feedback control, axial movement of the ball screw (i.e., displacement of the ball assembly) by servomotor torque is used. Further, an electronic automatic control is provided so that the servomotor will be actuated rapidly and a constant distance and a constant pressing force will be maintained.

FIG. 6 illustrates the electronic automatic control provided to maintain a constant roll-to-roll distance and a constant inter-roll pressure. The electronic automatic control comprises a controller C, such as a computer or processor, that is connected to receive the detection signals from the load sensor 10 and the laser sensor 18 and that outputs a drive signal to the servomotor S. The controller C executes a program that compares the detection signals with reference signals previously inputted by a keyboard or the like and outputs an appropriate drive signal (forward or reverse rotation drive signal) to the servomotor S to adjust the position of the front and/or rear rolls to maintain a constant distance between the front roll and center roll and between the rear roll and center roll and to maintain a constant pressing force between the front roll and center roll and between the rear roll and center roll. The detection signals from all the load sensors and laser sensors are inputted as feedback signals to the controller C, which monitors the detection signals and outputs appropriate correction signals in the form of drive signals to the corresponding servomotors to maintain a constant roll-to-roll distance and a constant inter-roll pressure.

As shown in FIG. 5, the control system illustrated in FIG. 6 (or the control system illustrated in FIG. 7) is disposed at four positions, i.e., left and right ends of the front roll 2 and left and right ends of the rear roll 3. The linear motion guides 14,15 are mounted on the frame on the same plane, and left and right ends of the center roll are fixed to the frame. When the roll mill is operated, the distance between rolls and the inter-roll pressing force applied to the rolls are detected by the laser sensors 18 and the load sensors (load cells) 10. By driving the servomotors S in response to the feedback of the detection signals from the sensors, the roll shafts 16 of the front and rear rolls 2,3 are slightly moved in a perpendicular direction relative to the center roll 1, by which optimum operation can be made automatically with a constant distance under a constant pressing force, thereby obtaining improved dispersion effects. At this time, as mentioned above, automatic control by a computer- or processor-executed program is made on the basis of the control of displacement in which the load is monitored by the load sensor and the distance between rolls is controlled by the laser sensor. The program is composed so that when a large disturbance occurs, the control is temporarily changed from the control of displacement to the control of load, and immediately after constraint of the disturbance, the control is returned from the control of load to the control of displacement. The program also determines the distance between the rolls as a numerical value obtained by adding a function e(t) which represents a fluctuation of the film thickness of the materials through the nip with time to the distance D between the roll shafts taking into account the collapse (deformation) of the rolls under operation.

Obvious changes and modifications to the roll mill will become apparent to those of ordinary skill in the art, and the present invention is intended to cover all such changes and modifications that fall within the scope and spirit of the appended claims.

What is claimed is:

1. A roll mill for a milling-dispersing treatment of a substance in a material to be treated, the roll mill comprising:

a fixed roll fixed to a frame;

a transfer roll mounted for movement into and out of pressing contact with the fixed roll, the transfer roll being installed on the frame through a linear motion guide to be slightly movable in a direction perpendicular to the fixed roll by a servomotor and a ball screw;

a laser sensor that directly irradiates the transfer roll with a laser beam to measure the distance between the rolls;

a load sensor for measuring a pressing force between the rolls; and an electronic automatic control device for keeping a constant distance and a constant pressing force between the fixed roll and the transfer roll by feedback of detection signals from the laser and load sensors, wherein the servomotor is driven by the electronic automatic control device to adjust the position of the transfer roll.

2. A roll mill according to claim 1; wherein the roll mill is a triple roll mill having three rolls arranged in parallel in a lateral direction, wherein the fixed roll is a center roll fixed at the center of the frame, and the transfer roll comprises a front roll and a rear roll disposed before and behind the center roll, and wherein each transfer roll is movable in a direction perpendicular to the center roll by the servomotor and ball screw so that the pressing force on a contact line between the center roll and front roll and between the center roll and rear roll can be made equal at any position along the contact line.

3. A roll mill according to claim 2; wherein each of the front roll, center roll and rear roll is provided with a crown, and the feedback to the electronic automatic control device includes the change of pressing force caused by the difference of frictional force generated by the different numbers of revolutions between a pair of the front roll and center roll and a pair of the center roll and rear roll.

4. A roll mill according to claim 3; wherein the electronic automatic control device controls displacement of the rolls by monitoring a load by the load sensor and controlling the distance between the rolls by the laser sensor.

5. A roll mill according to claim 4; wherein the electronic automatic control device includes a program that controls operation of the roll mill so that when a large, but not a level of emergency shutdown, disturbance is caused, the control is temporarily changed from the control of displacement to the control of load by the load sensor, and immediately after constraint of the disturbance, the control is returned from the control of load to the control of displacement.

6. A roll mill according to claim 4; wherein the electronic automatic control device determines the distance between the rolls by a distance D between roll shafts taking into account deformation of the rolls under operation, a film thickness e of the materials through the nip between the rolls, and a function e(t) which represents a fluctuation of the film thickness e with time.

7. A roll mill according to claim 2; wherein each of the roll shafts of the front roll and rear roll is connected to a driving motor, and a Schmidt coupling is coupled between the driving motor and each of the roll shafts of the rolls to permit movement of the roll shafts in a direction perpendicular to the center roll while the roll shafts are being rotationally driven.

8. A roll mill comprising:

a fixed roll having an axis of rotation and fixed to a frame;

at least one transfer roll mounted on the frame to undergo displacement in a direction perpendicular to the axis of rotation of the fixed roll to bring the transfer roll into and out of pressing contact with the fixed roll;

a servomotor for each transfer roll that is rotationally driven in forward and reverse directions by a drive signal;

a ball screw mechanism for each transfer roll that translates rotational motion of the servomotor to linear motion that is transmitted to the transfer roll to displace the transfer roll toward or away from the fixed roll in accordance with forward or reverse rotation of the servomotor;

a distance sensor for each transfer roll that measures the distance between the fixed and transfer rolls and outputs a detection signal corresponding to the measured distance;

a load sensor for each transfer roll that measures a pressing force between the fixed and transfer rolls and outputs a detection signal corresponding to the measured pressing force; and a controller that receives the detection signals from the distance and load sensors and produces a drive signal that is output to each servomotor to rotationally drive the servomotor so as to maintain a constant distance and a constant pressing force between the fixed roll and each transfer roll.

9. A roll mill according to claim 8: wherein the roll mill is a triple roll mill having the fixed roll as a center roll, and two transfer rolls disposed before and after the center roll as front and rear rolls, the three rolls being disposed in parallel in a lateral direction with each transfer roll being mounted on the frame to undergo displacement in a direction perpendicular to the axis of rotation of the center roll to bring the transfer roll into and out of pressing contact with the center roll.

10. A roll mill according to claim 9: including a ball screw mechanism and a servomotor disposed at opposite ends of each transfer roll for displacing the transfer roll.

11. A roll mill according to claim 9; wherein each transfer roll has a roll shaft extending outwardly from opposite ends thereof, the roll shafts being inserted into and rotatably supported by respective roll bearing holders: and wherein each roll bearing holder is displaceable by a corresponding servomotor and ball screw mechanism.

12. A roll mill according to claim 11: further including, for each transfer roll, a Schmidt coupling connected at one end thereof to the roll shaft and connectable at the other end thereof to a drive motor that rotationally drives the transfer roll.

13. A roll mill according to claim 8; including a ball screw mechanism and a servomotor disposed at opposite ends of each transfer roll for displacing the transfer roll.

14. A roll mill according to claim 8; wherein each transfer roll has a roll shaft extending outwardly from opposite ends thereof, the roll shafts being inserted into and rotatably supported by respective roll bearing holders; and wherein each roll bearing holder is displaceable by a corresponding servomotor and ball screw mechanism.

15. A roll mill according to claim 8; further including, for each transfer roll, a Schmidt coupling connected at one end thereof to the roll shaft and connectable at the other end thereof to a drive motor that rotationally drives the transfer roll.

16. A roll mill according to claim 8; wherein the controller executes a program that compares the detection signals with reference data and outputs a drive signal to each servomotor.

17. A roll mill according to claim 8; wherein each distance sensor comprises a laser sensor that irradiates the transfer roll with a laser beam to measure the distance between the transfer roll and the fixed roll.

18. A roll mill according to claim 17; wherein each transfer roll is mounted on and supported by a linear motion guide that guides displacement of the transfer roll in a direction perpendicular to the axis of rotation of the fixed roll.

19. A roll mill according to claim 8; wherein each transfer roll is mounted on and supported by a linear motion guide that guides displacement of the transfer roll in a direction perpendicular to the axis of rotation of the fixed roll.

* * * * *